United States Patent [19]

Hirahara et al.

[11] Patent Number: 4,624,630

[45] Date of Patent: Nov. 25, 1986

[54] DIFFERENTIAL PRESSURE LUBRICATION SYSTEM FOR ROLLING PISTON COMPRESSOR

[75] Inventors: Takuho Hirahara; Koji Ishijima; Fumiaki Sano; Fumio Wada; Kazutomo Asami, all of Shizuoka; Masahiro Sugihara, Wakayama, all of Japan

[73] Assignee: Mitsubishi Denki Kabushiki Kaisha, Japan

[21] Appl. No.: 708,905

[22] Filed: Mar. 6, 1985

[30] Foreign Application Priority Data

Mar. 8, 1984 [JP] Japan ..... 59-44548

[51] Int. Cl.[4] ..... F04C 18/356; F04C 29/02; H02K 3/04

[52] U.S. Cl. ..... 418/63; 418/91; 418/99; 310/191; 310/209

[58] Field of Search ..... 418/63, 91, 94, 98, 418/99; 417/365, 410; 310/191, 209; 184/6.16

[56] References Cited

U.S. PATENT DOCUMENTS

| | | | |
|---|---|---|---|
| 1,725,390 | 8/1929 | Brouse | 418/63 |
| 2,130,349 | 9/1938 | Kucher | 417/410 |
| 2,195,835 | 4/1940 | Bilderbeck | 418/63 |
| 2,306,608 | 12/1942 | Hubacker | 418/63 |
| 2,988,267 | 6/1961 | Kosfeld | 418/63 |

FOREIGN PATENT DOCUMENTS

| | | | |
|---|---|---|---|
| 619583 | 10/1935 | Fed. Rep. of Germany | 310/209 |
| 58-131393 | 8/1983 | Japan | 418/98 |

OTHER PUBLICATIONS

SAE Technical Paper Series No. 830539, *Dual Cylinder Rolling Piston Rotary Compressor for Automotive Air Conditioner,* 1983 Society of Automotive Engineers, Inc., Salem, MA.

*Primary Examiner*—John J. Vrablik
*Attorney, Agent, or Firm*—Sughrue, Mion, Zinn, Macpeak, and Seas

[57] ABSTRACT

The lubricating oil pool 11 in the bottom of the shell 1 of a rolling piston refrigerant gas compressor is communicated directly with the space 16 inside the cylindrical piston 4 via a supply passage 10c in a side plate 10. Sufficient clearance is provided between the ends of the piston and the compressor side plates 9, 10 to enable limited communication between the space 16 and the compression and suction chambers 6, 18. The compressor discharge is supplied to the space 7 within the shell, and the resultant differential pressure applied to opposite ends of the supply passage causes a steady flow of oil into the piston interior to properly lubricate the moving parts of the compressor.

7 Claims, 11 Drawing Figures

FIG. 1
PRIOR ART
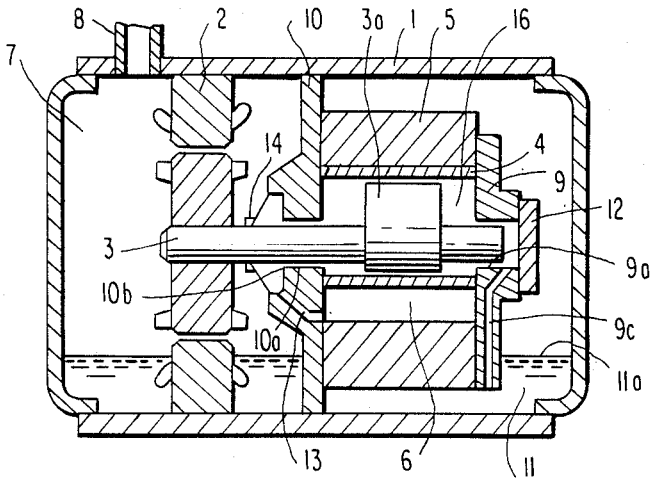
FIG. 2
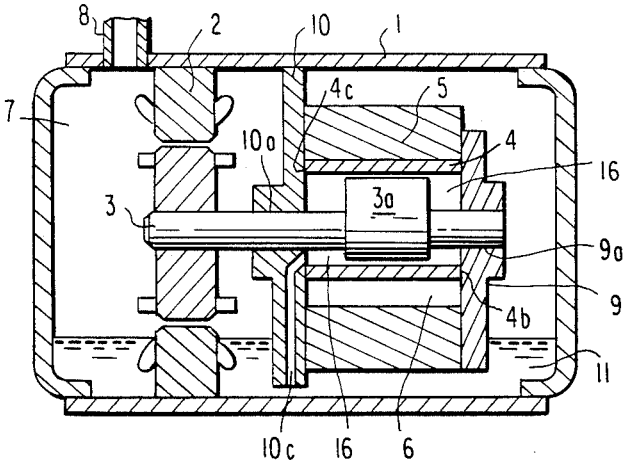
FIG. 3
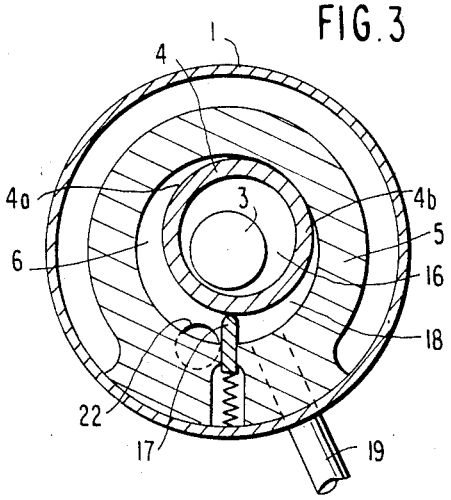
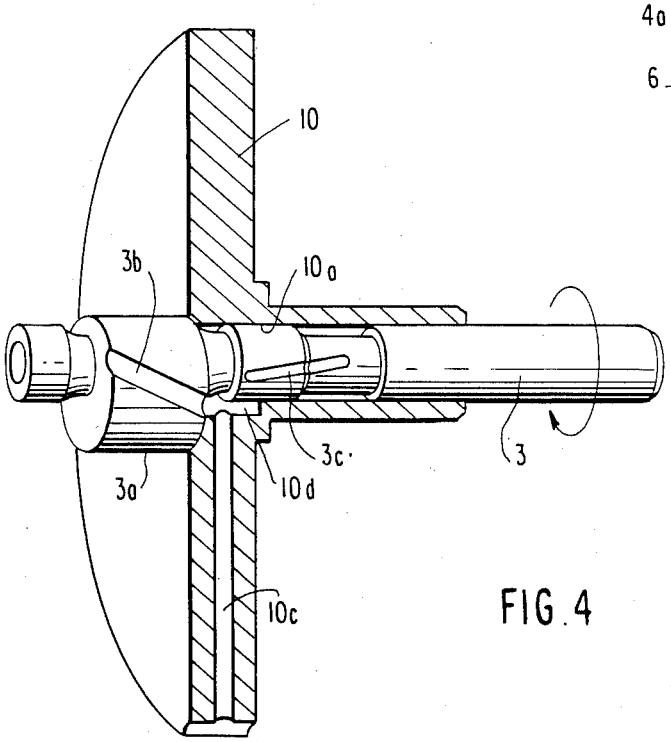
FIG. 4

FIG. 5
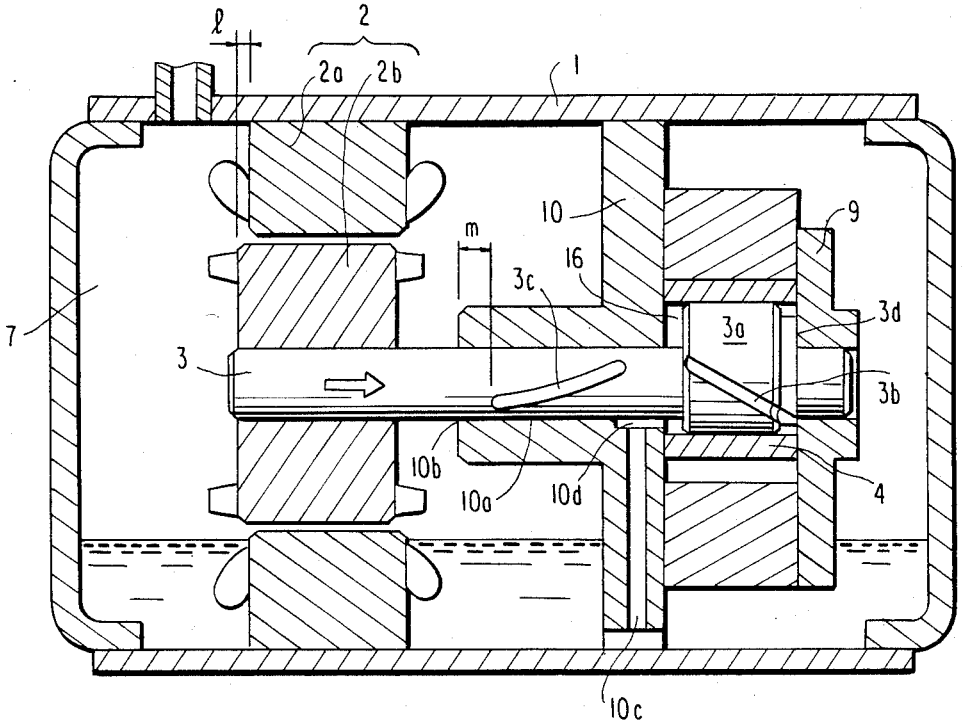
FIG. 6
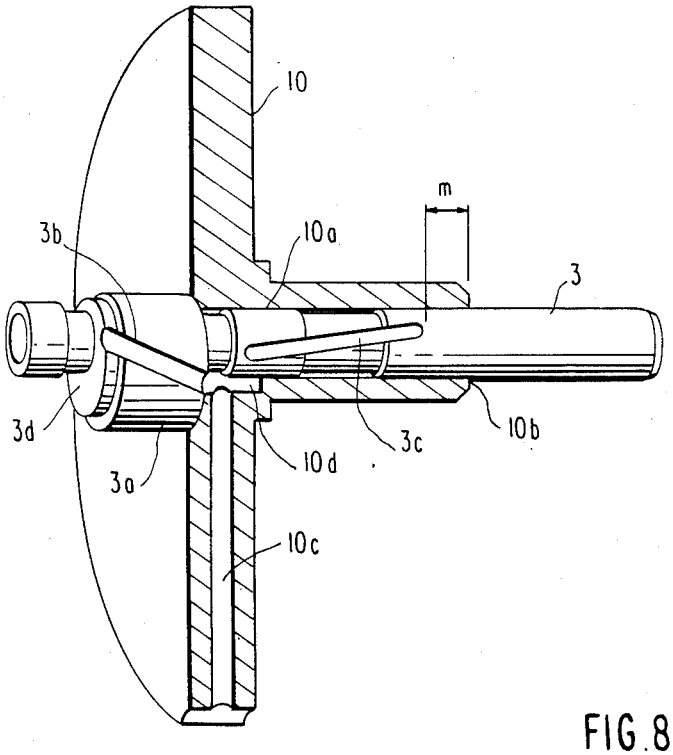
FIG. 7
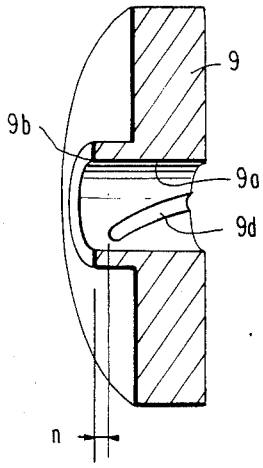
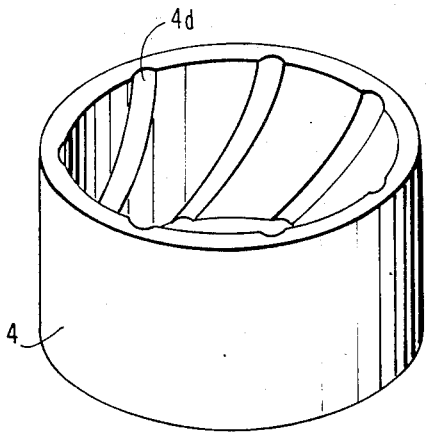
FIG. 8

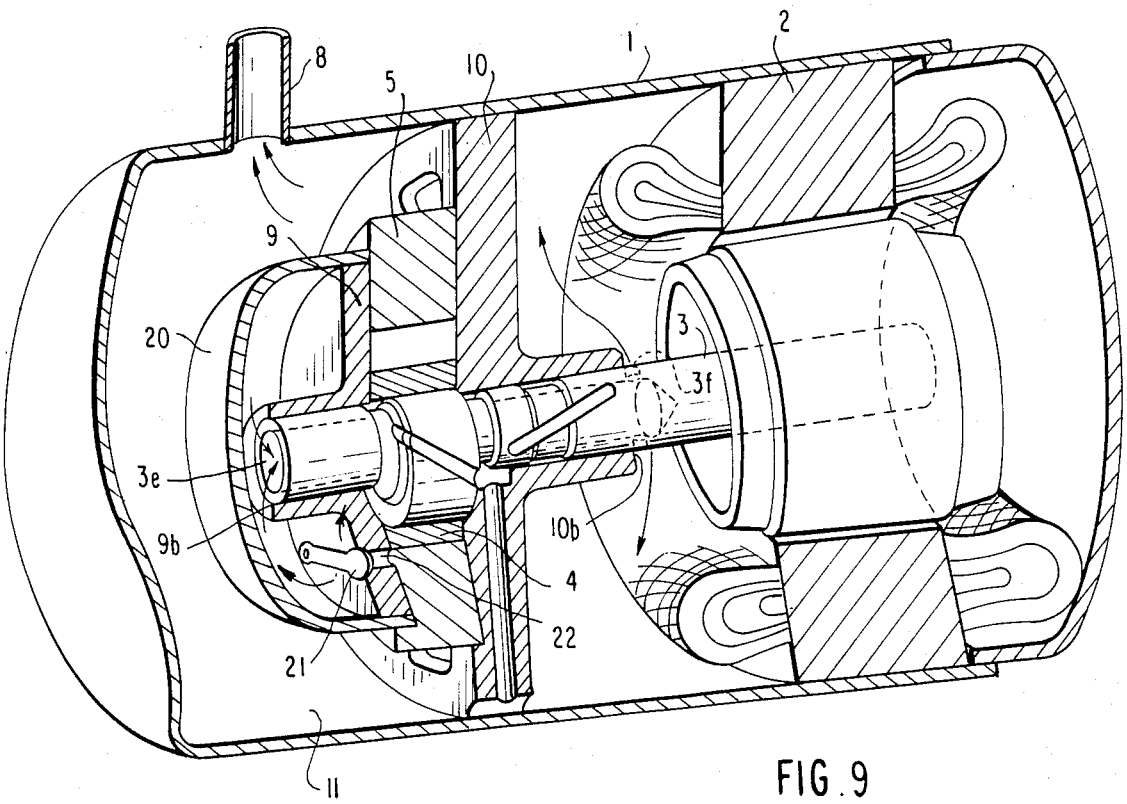
FIG. 9
FIG. 10
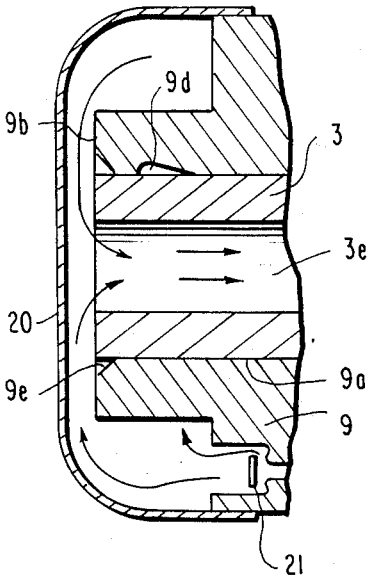
FIG. 11
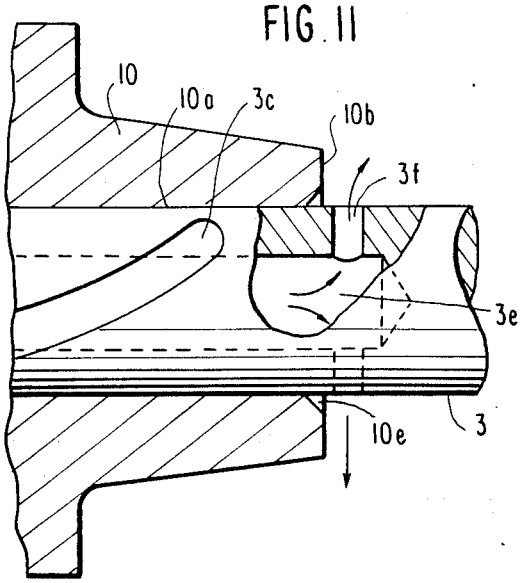

DIFFERENTIAL PRESSURE LUBRICATION SYSTEM FOR ROLLING PISTON COMPRESSOR

BACKGROUND OF THE INVENTION

This invention relates to an improved differential pressure lubrication system for an eccentric rolling piston, sliding vane type of fluid compressor, as particularly used to compress refrigerant gases in refrigerators and air conditioners.

In conventional units of this type an electric motor and a rolling piston compressor driven thereby are mounted within a sealed pressure shell or casing. Refrigerant gases drawn in from an external accumulator or the like are compressed and discharged into the space within the shell, from which they flow to a condenser, evaporator or the like. A pool of lubricating oil is maintained within the shell and its surface is in direct contact with the high pressure discharge from the compressor. An oil flow path is established to properly lubricate the rolling and sliding friction members of the compressor such that the high pressure or supply end of the path is simply immersed in the pool of oil while the low pressure or return end is communicated with a suction passage of the compressor. The resultant differential pressure between the supply and return ends of the path establishes a steady flow of lubricating oil through the frictional members of the compressor. Such a relatively high differential pressure often produces an attendantly excessive flow of lubricating oil, however, which unduly loads the compressor, generates vibrations, results in an excessive amount of lubricating oil being entrained in the refrigerant fluid, etc.

In an effort to solve this "over-lubrication" problem, as disclosed in laid-open Japanese patent application No. 131393/83 and as shown in FIG. 1, the low pressure or return side of the oil supply passage is communicated with the compression chamber of the compressor in order to reduce the overall differential pressure to which the lubrication system is subjected. More specifically, by the action of an electric motor 2 mounted in a sealed shell 1, a crankshaft 3 is rotated to reduce the volume in a compression chamber 6 defined between a rolling piston 4 and a cylinder 5 to thereby compress refrigerant gases drawn in from an accumulator or the like, not shown. The compressed gases are released into the space 7 within the shell from which they are supplied to a condenser or the like via a discharge outlet 8. The lubricating oil 11 enters the compressor through a passage 9*c* formed in a side plate 9 and lubricates, in succession, bearing 9*a* adjacent end seal 12, eccentric 3*a* and bearing 10*a* in side plate 10. The oil then flows into the compression chamber 6 through a return passage 13 in the side plate 10, from which it is discharged together with the compressed gas into the space 7 within the shell and falls back into the supply pool. The bearings 9*a*, 10*a* have a relatively large clearance as exaggeratedly shown in FIG. 1 to establish a sufficient flow path for the oil, while the tolerance or clearance between the ends of the piston 4 and the side plates 9, 10 is relatively close to thereby effectively isolate the space 16 within the piston from the compression chamber 6. The necessary lubricating oil is supplied to the latter through the return passage 13.

Since the mean or average pressure in the compression chamber 6 lies between the suction pressure and the discharge pressure, with the latter being applied directly to the surface 11*a* of the oil pool, the differential pressure applied to the opposite ends of the oil flow path is thus considerably lower than in the more conventional arrangement described above, and this attendantly reduces the oil flow rate to thereby avoid such problems as undue loading, vibration, etc.

A disadvantage with the FIG. 1 approach is that the pressure at the bearing end 10*b* of the side plate 10 must be isolated from the discharge pressure within the space 7 in the shell. This requires a mechanical seal 14 which not only adds to the production cost, but also increases the mechanical loss due to friction and represents a further source of wear and deterioration. A further disadvantage is that the oil flow path includes successive restrictions represented by the bearing 9*a*, the clearance between the eccentric and the inner surface of the piston 4, and the bearing 10*a*, and even a partial blockage at any one of these points can result in overheating, seizure, and the destruction of the entire compressor unit.

SUMMARY OF THE INVENTION

The present invention seeks to effectively avoid the drawbacks and disadvantages of the prior art as discussed above by providing a simplified and cost effective differential pressure lubrication system for a rolling piston compressor wherein the exit or return end of the oil supply passage is communicated directly with the circumferential space within the piston flanking the eccentric. The crankshaft bearings within the side plates are provided with closer tolerances than in the prior art to prevent any excessive outward flow of lubricating oil therethrough, and the clearances between the ends of the piston and the side plates are established at a sufficient value to enable an adequate flow of oil into the suction and compression chambers while still ensuring a sufficient compression seal. Such an arrangement eliminates the need for any bearing and shaft seals, thereby reducing the cost and complexity of the compressor.

BRIEF DESCRIPTION OF THE DRAWINGS

FIG. 1 is a schematic longitudinal section of a rolling piston compressor having a differential pressure lubrication system according to the prior art, FIG. 2 is a schematic longitudinal section of a rolling piston compressor having a differential pressure lubrication system in accordance with the present invention, FIG. 3 is a cross-section of the compressor shown in FIG. 2, FIG. 4 is a part sectioned perspective of a compressor side plate with a crankshaft and eccentric journaled therein in accordance with the invention, FIG. 5 is a longitudinal section of a compressor in accordance with a further embodiment of the invention, FIG. 6 is a part sectioned perspective showing the side plate and journaled crankshaft/eccentric of FIG. 5, FIG. 7 is a sectioned perspective of an opposite side plate in accordance with the invention, FIG. 8 is a perspective of a rolling piston in accordance with a modification of the invention, FIG. 9 is a part sectioned perspective of a further embodiment of the invention, and FIGS. 10 and 11 are enlarged sectional views of the side plate bearings of FIG. 9.

DETAILED DESCRIPTION OF THE PREFERRED EMBODIMENTS

Referring now to a first embodiment of the invention as illustrated schematically in FIGS. 2 and 3, wherein like reference numerals are used to designate the same structural elements as shown in FIG. 1, a sliding vane 17 separates the compression chamber 6 and a suction chamber 18 within the cylinder 5, the former communicating with a discharge orifice 22 and the latter communicating with a suction inlet 19. The vane is reciprocated by the outer surface 4*a* of the eccentrically driven rolling piston 4. An oil supply passage 10*c* defined in the side plate 10 has its lower end in direct communication with the oil pool 11 and its upper end in direct communication with the inner circumferential space 16 within the piston. The side plate bearings 9*a*, 10*a* are machined to closer tolerances than those of FIG. 1 to limit the outward flow of oil therethrough, and the clearances between the ends 4*b*, 4*c* of the piston and the side plates 9, 10 are established at a sufficient level or value, on the order of several tens of microns, to enable a sufficient passage of lubricating oil between the space 16 and the compression and suction chambers 6, 18 while still maintaining an adequate compression seal.

With such a construction the discharge pressure in the space 7 within the shell forces the oil up through supply passage 10*c* and into the space 16, whose pressure takes a level between the suction and discharge pressures owing to the limited communication with the compression and suction chambers 6, 18 via the clearances at the ends 4*b*, 4*c* of the piston. The oil thus drawn into the space 16 effectively lubricates the side plate bearings 9*a*, 10*a* as well as the contact surfaces between the eccentric 3*a* and the inside of piston 4, and small but sufficient amounts of such oil are also "pumped" into and out of the compression and suction chambers to coat them with a thin film and thereby lubricate their surfaces. Some of the lubricating oil will pass from the space 16 into the shell space 7 through the side plate bearings 9*a*, 10*a*, while greater quantities of oil will exit the compression chamber 6 through the discharge orifice 22 in a fine mist. These minute oil particles or droplets condense into larger particles due to the high pressure level in the space 7 and fall back into the pool 11. Some small quantities of the oil mist will unavoidably be entrained in the compressed refrigerant gas exiting through the discharge outlet 8, but this is common and does not appreciably detract from the system performance. If necessary or desired a downstream separator can be provided in the system to filter out and return such oil particles.

FIG. 4 shows in greater detail a side plate 10 and crankshaft 3 journaled therein for use in the schematic embodiment of FIGS. 2 and 3, although the presentation of FIG. 4 is reversed or as viewed from the back side of FIG. 2. The upper end of the oil supply passage 10*c* terminates in a recess or pit 10*d* in the side plate 10, the eccentric 3*a* is provided with an oblique or helical groove 3*b*, and a portion of the crankshaft disposed within the side plate bearing 10*a* is provided with a similar oblique or helical groove 3*c*. The pit 10*d* and groove 3*c* facilitate the lateral dispersion of lubricating oil throughout the bearing 10*a* since one end of the groove 3*c* comes into direct communication with the pit during each rotation of the crankshaft. Although not clearly visible in FIG. 4, the pit 10*d* also opens directly into the space 16 within the piston 4 on the right side of the eccentric as viewed in FIG. 4; the groove 3*b* facilitates the distribution of the lubricating oil to the space 16 on the left side of the eccentric and thence to the opposite side plate bearing 9*a*.

The embodiment of FIGS. 5 and 6 is characterized by the stator 2*a* of the electric drive motor being axially displaced from the rotor 2*b* a distance 1, by the crankshaft groove 3*c* extending to a distance m from the bearing end 10*b* of the side plate, and by a thrust bearing or pedestal 3*d* being formed on the end of the eccentric adjacent the side plate 9. With such a construction the axial offset between the rotor and stator of the drive motor generates a thrust force in the direction indicated by the arrow in FIG. 5, and such force is borne by the thrust bearing 3*d*. This arrangement ensures that the crankshaft is constantly urged against the side plate 9, which effectively suppresses any vibrations and attendant noise which might be generated by the axial freedom and movement of the crankshaft.

The groove 3*b* in the eccentric is extended into the thrust bearing 3*d* to ensure the proper lubrication of the face thereof and to implement the lateral distribution of the oil to the side plate bearing 9*a*. Moreover, the extension of the crankshaft groove 3*c* to the distance m from the bearing end 10*b* ensures the full and effective lubrication of the side plate bearing 10*a*.

FIG. 7 shows a construction of the side plate 9 wherein a helical groove 9*d* is formed in the bearing portion 9*a* and extends to a distance n from the bearing end 9*b* to ensure the proper lateral distribution of the lubricating oil. As an obvious alternative, a groove corresponding to 9*d* could instead be provided on the left end of the crankshaft as viewed in FIG. 6, similar to the groove 3*c*.

FIG. 8 shows a modification wherein the interior or bearing surface of the rolling piston 4 is provided with a plurality of helical grooves 4*d* to replace the groove 3*b* in the eccentric.

In the embodiment of FIGS. 9–11 the crankshaft is provided with a central coaxial bore 3*e* extending from the compressor end thereof to a point just beyond the bearing end 10*b* whereat radial outlet ports 3*f* are provided, and a cap 20 is fitted over the side plate 9 to enclose both the bearing boss of the latter and a discharge valve 21 communicating with the compression chamber 6 via the discharge orifice 22. This establishes a high speed flow of the compressed refrigerant gas through the crankshaft bore 3*e* and out the radial ports 3*f* along the path shown by the arrows. With the cap 20 disposed in close proximity to the bearing end 9*b* of the side plate a high velocity flow is established into the bore 3*e* as seen in FIG. 10, and in a similar manner with the ports 3*f* having a sufficiently small diameter a corresponding high velocity gas flow is also established across the bearing end 10*b* of the opposite side plate. If the bearing ends of the respective side plates are now provided with chamfers 9*e* and 10*e* as shown in FIGS. 10 and 11 surrounding the crankshaft, the high velocity gas flows induce low pressure regions in the chamfer recesses and this assists in drawing out lubricant from the ends of the grooves 9*d* and 3*c* to ensure a steady supply of oil to the ends of bearings 9*a* and 10*a*.

As will be obvious to those skilled in the art, the principles of this invention are equally applicable to both horizontally and vertically oriented compressors although only the former have been shown in the drawings by way of example. In the case of a vertically oriented compressor the side plate 10 would be disposed above the surface 11*a* of the oil pool, and the supply passage 10*c* would simply be extended by a tube leading downwardly and terminating in the pool. As is also obvious, the oil supply passage could just as well be provided in the side plate 9, or for that matter a passage could be provided in both side plates. Such passage could also be provided by a separate length of tubing extending from the oil pool through one of the side plates and into the space 16.

By way of representative example, the clearance between the crankshaft and the side plate bearings 9*a*, 10*a* may be on the order of 10~20 microns, and that between the ends of the piston 4 and the side plates may be on the order of 3~30 microns.

What is claimed is:

1. In a rolling piston, sliding vane fluid compressor, particularly for refrigerant gases, including a closed shell (1), an electric motor (2) mounted within the shell, a shaft (3) rotatably driven by the motor at one end and adapted to turn with its axis disposed horizontally, a compressor cylinder (5) flanked by vertical side plates (9, 10) at its opposite ends and disposed with its axis parallel to the shafted axis and being mounted within the shell, an eccentric (3*a*) fixed to said shaft and abutting a bearing means on one of said side plates, the shaft extending through the cylinder and side plates and being journaled in bearings (9*a*, 10*a*) in the side plates, a hollow cylindrical rolling piston (4) disposed within the cylinder with its axis parallel to the shaft axis, said eccentric being rotatably disposed within the piston, a sliding vane (17) radially mounted in the cylinder and engaging the outer surface of the piston to define compression and suction chambers (6, 18), a suction inlet (19) to the suction chamber, a discharge outlet (22) from the compression chamber in communication with a space (7) within the shell, and a pool of lubricating oil (11) in a lower portion of the shell, an improved differential pressure lubrication system characterized by:

a substantially vertical oil supply passage (10*c*) having one end in communication with the oil pool and another, opposite end, in communication with a space (16) within the piston, said space being defined by said vertical side plates, the internal walls of said piston and the volume of the eccentric, whereby the pressure exerted on the oil pool by compressed refrigerant gas within the shell space forces oil through the supply passage and into the lower pressure piston space to thereby lubricate the moving parts of the compressor.

2. A compressor according to claim 1, wherein the oil supply passage (10*c*) is defined in one of the side plates.

3. A compressor according to claim 2, wherein said opposite end of the passage is defined by a recessed pit (10*d*) in the bearing (10*a*) of said one side plate.

4. A compressor according to claim 3, wherein helical oil distribution grooves (3*b*, 3*c*) are formed in the eccentric and in a portion of the shaft journaled in said one side plate bearing, the shaft groove communicating with the pit during each revolution of the shaft.

5. A compressor according to claim 3, wherein a plurality of helical oil distribution grooves are formed in the inner circumferential surface of the piston.

6. A compressor according to claim 4, wherein rotor and stator members of the motor are axially displaced to generate an axial thrust force during operation, and an end of the eccentric defines a thrust bearing pedestal urged against said one side plate by said force.

7. A compressor according to claim 4, wherein the shaft is centrally bored (3*e*) from a compressor end thereof to a point just past an outermost end (10*b*) of a side plate bearing closest the motor, radial ports (3*f*) communicate a bottom of the shaft bore with the shell space, the outermost ends of both side plate bearings are chamfered (9*e*, 10*e*), and an end cap (20) encloses the discharge outlet and a side plate bearing boss most remote from the motor, whereby a high velocity flow of compressed refrigerant gas is established through the bore and across both bearing ends to induce lower pressures in the chamfers and thereby draw lubricating oil through the bearings.

* * * * *